US005238397A

United States Patent [19]

Boklep et al.

[11] Patent Number: 5,238,397

[45] Date of Patent: Aug. 24, 1993

[54] DEVICE FOR THE COMBUSTION OF VISCOUS FLUIDS

[75] Inventors: Magne Boklep, Gjora; Nils A. Soyseth, Kvanne, both of Norway

[73] Assignee: Norsk Hydro A.S., Oslo, Norway

[21] Appl. No.: 750,984

[22] Filed: Aug. 28, 1991

[30] Foreign Application Priority Data

Aug. 31, 1990 [NO] Norway ..... 903811

[51] Int. Cl.[5] ..... F23D 11/38

[52] U.S. Cl. ..... 431/121; 431/11; 431/202; 110/237

[58] Field of Search ..... 431/202, 3, 121, 5, 431/11; 137/405, 590; 184/6.28, 1.5, 6.5; 123/196 R, 6.5; 110/237, 239

[56] References Cited

U.S. PATENT DOCUMENTS

| | | | |
|---|---|---|---|
| Re. 31,241 | 5/1983 | Klaila | 431/11 |
| 2,859,806 | 11/1958 | Lake et al. | 431/41 X |
| 3,123,983 | 3/1964 | Sliepcevich | 417/405 X |
| 3,565,021 | 2/1971 | Hill | 110/238 |
| 4,105,093 | 8/1978 | Dickinson | 184/104.1 X |
| 4,265,611 | 5/1981 | Reed et al. | 431/202 X |
| 4,533,316 | 8/1985 | Takino et al. | 431/208 X |
| 4,877,395 | 10/1989 | Schubach et al. | 431/208 X |

*Primary Examiner*—Larry Jones

*Attorney, Agent, or Firm*—Wenderoth, Lind & Ponack

[57] ABSTRACT

An apparatus for combustion of viscous liquids such as tar from gas filters or the like includes a tank with heating elements, a burner unit and pipe connecting the burner with the tank. The pipe extends into the tank, and an end of the pipe within the tank is connected to a dosage pump of the displacement type.

11 Claims, 1 Drawing Sheet

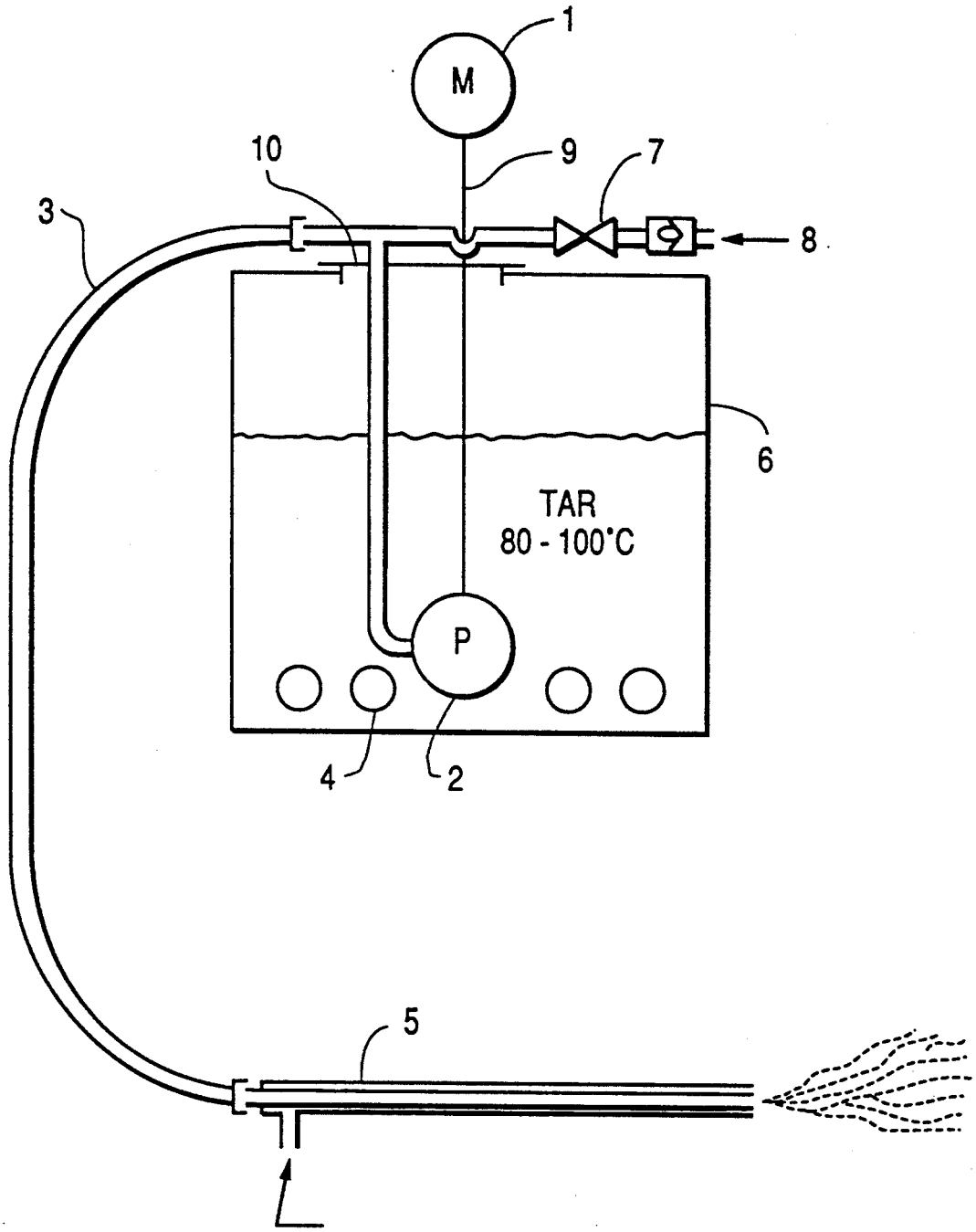
1
M
10
9
7
3
8
6
TAR
80 - 100°C
P
4
2
5

DEVICE FOR THE COMBUSTION OF VISCOUS FLUIDS

BACKGROUND OF THE INVENTION

The present invention relates to an apparatus for combustion of viscous fluids such as tar from filters for gas cleaning purposes or the like, and including a tank or container with heating elements, a burner unit, and a pipe for connecting the burner unit with the tank.

Carbon bodies used in electrolysis cells for producing aluminum are prebaked (calcinated) in so-called ring section furnaces. Due to strong environment demands, the gases from such furnaces are cleaned, and one component which is separated during such cleaning is tar. The tar represents a disposal problem as it contains toxins (PAH), and has otherwise been difficult to burn due to its consistency (viscosity at room temperature and contents of particles). Attempts have been made to provide equipment for combustion of the tar, but such equipment has proved not to be useful because of repeating operating problems due to clogged valves and feeding pumps and to carburization of combustion nozzles.

SUMMARY OF THE INVENTION

In view of the problems with known equipment, it was decided to develop specially designed equipment or apparatus for combustion of filter tar. An important object of the invention is to provide combustion equipment or apparatus that is reliable, i.e. where problems of clogging and carburization are eliminated and where wear of the equipment is reduced, i.e. the equipment has a long operating life. Further, it is an object of the invention to provide such apparatus or equipment which will be inexpensive and simple to maintain.

The invention is characterized in that the pipe that connects the tank with the burner extends into the tank and that an end of the pipe inside the tank is connected to a dosage pump of the displacement type. With such arrangement the pipe is prevented from being clogged, as no valves, filters or other narrow passages are provided in the pipe. Further, since the pump is submerged in heated liquid in the tank, problems related to congealing of the liquid in the pump are avoided.

According to a preferred feature of the invention, the pipe, at a position close to the tank, is provided with air evacuation means. Thereby the liquid is prevented from congealing in the pipe as it can be evacuated by air being blown through the pipe when the pump is stopped or is out of order.

By disposing a motor for the pump outside the tank, and preferably on an inspection cover, simple mounting and maintenance together with a more reliable operation are achieved.

BRIEF DESCRIPTION OF THE DRAWING

The invention now will be further described by way of example and with reference to the accompanying drawing which is a schematic view of an apparatus for combustion of viscous liquids according to the invention.

DETAILED DESCRIPTION OF THE INVENTION

The apparatus of the invention comprises a tank or container 6 with heating elements 4 controlled by a thermostat, a burner unit 5, and a pipe 3 for transferring liquid from the tank 6 to the burner unit 5. The pipe 3 extends into the tank 6, and to an end of the pipe 3 positioned slightly above the bottom of the tank is connected a dosage pump 2. The part of the pipe 3 that extends into the tank preferably is made of metal, whereas the portion of the pipe outside the tank 6 may be flexible and made of a suitable rubber composition. The dosage pump 2 is driven via a shaft 9 by a motor 1 which is disposed outside the tank. The purpose of providing the motor outside the tank is to prevent it from being exposed to the high temperatures of the liquid in the tank, and also to avoid problems related to sealing and mounting of electrical or hydraulical cables or pipes which otherwise would have to be led into the tank in connection with the pump drive. With the above described arrangement where the pump is provided in connection with the pipe inside the tank, there are no valves, filters or other positions along the pipe whereat clogging might occur.

The pipe 3 is, in the vicinity of the tank 6, provided with air flushing means in the form of an air flushing pipe 8. By opening a valve 7 in the air flushing pipe 8, the liquid in the pipe 3 can be evacuated therefrom, e.g. if the motor 1 is stopped or the apparatus for other reasons comes to a halt. As a further measure, the pipe 3 also may be provided with a heating element (not shown) to prevent clogging.

To make it easier to mount and perform maintenance, the pipe 3 and the motor 1/dosage pump 2 are connected to an inspection cover 10 on top of the tank 6. Thus, the pipe and the pump can be removed from the tank by lifting the cover 10 from the tank, and mounting and maintenance operations may be conducted outside the tank.

As previously mentioned, the tank is provided with heating elements 4 which are controlled by a thermostat. To prevent heat losses from the tank and to prevent the liquid from achieving high viscosity or congealing in the pipe, both the pipe and tank are provided with heat insulation. The pump, or rather the motor 1, is controlled via a frequency transformer by means of a computer. Thereby, it is possible to achieve precise dosing and in turn precise temperature control for the combustion process.

Even though the apparatus of the invention is particularly developed to burn tar from gas filters, it is evident that the apparatus can be used for burning other viscous liquids having high viscosity and particle content.

We claim:

1. An apparatus for the combustion of a material that is highly viscous and that tends to solidify at room temperature, such as tar from gas cleaning filters or the like, said apparatus comprising:

a tank to contain in an interior thereof such viscous material to be combusted;

at least one heating element positioned for heating the viscous material to be contained in said interior of said tank and thereby for lowering the viscosity of the material to ensure liquefication thereof;

a burner unit to combust the thus liquefied material;

a pipe to supply the liquefied material from said tank to said burner unit, said pipe having an inlet end extending into said interior of said tank to be submerged in the liquefied material;

a dosage pump for pumping a dosed amount of the liquefied material from said interior of said tank through said pipe to said burner unit; and means for preventing clogging of said pump by the material, said means comprising said pump being positioned within said interior of said tank and connected to said inlet end of said pipe at a location such that said pump will be submerged in the heated and liquefied material and such that all of the material pumped through said pump will be heated and liquefied and thereby will be prevented from clogging said pump.

2. An apparatus as claimed in claim 1, wherein said at least one heating element is positioned within said interior of said tank.

3. An apparatus as claimed in claim 2, comprising plural said heating elements.

4. An apparatus as claimed in claim 1, further comprising a gas flushing device connected to said pipe to flush therefrom liquefied material to prevent clogging of said pipe by the material.

5. An apparatus as claimed in claim 4, wherein said gas flushing device is connected to said pipe at a position exterior of said tank.

6. An apparatus as claimed in claim 5, wherein said position is in close proximity to said tank.

7. An apparatus as claimed in claim 4, wherein said gas flushing device comprises means for injecting air through that portion of said pipe located exteriorly of said tank.

8. An apparatus as claimed in claim 1, wherein said pump comprises a gear wheel pump.

9. An apparatus as claimed in claim 1, further comprising a pump drive motor positioned exteriorly of said tank and having an output shaft extending into said interior of said tank and operatively connected to said pump to drive said pump.

10. An apparatus as claimed in claim 1, wherein said tank includes a removable inspection cover, and said pump and said end of said pipe are supported by said cover, such that removal of said cover from said tank results in withdrawal of said pump and said end of said pipe from said interior of said tank.

11. An apparatus as claimed in claim 1, wherein said pipe extends directly from said pump to said burner unit without interposition therebetween of any valves or filters.

* * * * *